US009681787B2

(12) United States Patent
Makarov et al.

(10) Patent No.: US 9,681,787 B2
(45) **Date of Patent: *Jun. 20, 2017**

(54) DUAL STAGE CYCLONE VACUUM CLEANER

(71) Applicant: Techtronic Floor Care Technology Limited, Tortola (VG)

(72) Inventors: Sergey V. Makarov, Solon, OH (US); Raymond P. Kawolics, Macedonia, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

This patent is subject to a terminal disclaimer.

(21) Appl. No.: 15/062,445

(22) Filed: Mar. 7, 2016

(65) Prior Publication Data

US 2016/0183753 A1 Jun. 30, 2016

Related U.S. Application Data

(63) Continuation of application No. 13/736,522, filed on Jan. 8, 2013, now Pat. No. 9,277,846, which is a (Continued)

(51) Int. Cl.

| | |
|---|---|
| ***A47L 9/16*** | (2006.01) |
| *A47L 5/28* | (2006.01) |
| *A47L 9/20* | (2006.01) |

(52) U.S. Cl.

CPC ..... *A47L 9/1683* (2013.01); *A47L 9/1625* (2013.01); *A47L 9/1641* (2013.01); *A47L 5/28* (2013.01);

(Continued)

(58) Field of Classification Search

CPC . A47L 5/28; A47L 9/20; A47L 9/1691; A47L 9/1666; A47L 9/1623; A47L 9/1683; A47L 9/1641; A47L 9/1625

See application file for complete search history.

(56) References Cited

U.S. PATENT DOCUMENTS

| | | |
|---|---|---|
| 1,416,995 A | 5/1922 | Stroud |
| 1,759,947 A | 5/1930 | Lee |

(Continued)

FOREIGN PATENT DOCUMENTS

| | | |
|---|---|---|
| EP | 0728435 | 8/1996 |
| WO | 2005053855 | 6/2005 |
| WO | 2006010881 | 2/2006 |

*Primary Examiner* — David Redding

(74) *Attorney, Agent, or Firm* — Michael Best & Friedrich LLP

(57) ABSTRACT

A vacuum cleaner including a dust collector having a first stage cyclonic separator, a plurality of second stage cyclonic separators, a dirt cup configured to collect dust particles separated by the first stage cyclonic separator, and a perforated tube at least partially within the dust collector. The perforated tube includes a cylindrical wall and a plurality of openings in the cylindrical wall to allow the flow of air to pass through the cylindrical wall in a flow direction from the first stage cyclonic separator toward the plurality of second stage cyclonic separators. A plurality of isolated air conduits within the perforated tube. Each of the plurality of isolated air conduits defined at least partially by walls extending in a direction inwardly from the cylindrical wall of the perforated tube and each of the plurality of second stage cyclonic separators has a corresponding one of the plurality of isolated air conduits.

20 Claims, 13 Drawing Sheets

Related U.S. Application Data continuation of application No. 12/097,225, filed as application No. PCT/US2006/048800 on Dec. 22, 2006, now Pat. No. 8,438,700.

(60) Provisional application No. 60/753,334, filed on Dec. 22, 2005.

(52) U.S. Cl.
CPC ..... *A47L 9/1666* (2013.01); *A47L 9/1691* (2013.01); *A47L 9/20* (2013.01)

(56) References Cited

U.S. PATENT DOCUMENTS

| | | | |
|---|---|---|---|
| 3,308,609 | A | 3/1967 | McCulloch et al. |
| 3,320,727 | A | 5/1967 | Farley et al. |
| 3,425,192 | A | 2/1969 | Davis |
| 3,769,781 | A | 11/1973 | Klein et al. |
| 4,373,228 | A | 2/1983 | Dyson |
| 4,610,048 | A | 9/1986 | Ishihara et al. |
| 4,853,008 | A | 8/1989 | Dyson |
| 5,078,767 | A | 1/1992 | Berkey |
| 5,135,552 | A | 8/1992 | Weistra |
| 5,778,745 | A | 7/1998 | Furusawa et al. |
| 5,893,936 | A | 4/1999 | Dyson |
| 6,070,291 | A | 6/2000 | Bair et al. |
| 6,141,826 | A | 11/2000 | Conrad et al. |
| 6,334,234 | B1 | 1/2002 | Conrad et al. |
| 6,344,064 | B1 | 2/2002 | Conrad |
| 6,391,095 | B1 | 5/2002 | Conrad et al. |
| 6,406,505 | B1 | 6/2002 | Oh et al. |
| 6,408,481 | B1 | 6/2002 | Dyson |
| 6,502,278 | B2 | 1/2003 | Oh et al. |
| 6,582,489 | B2 | 6/2003 | Conrad |
| 6,598,263 | B2 | 7/2003 | Boles et al. |
| 6,599,340 | B2 | 7/2003 | Conrad et al. |
| 6,607,572 | B2 | 8/2003 | Gammack et al. |
| 6,613,129 | B2 | 9/2003 | Gen |
| 6,736,873 | B2 | 5/2004 | Conrad et al. |
| 6,746,500 | B1 | 6/2004 | Park et al. |
| 6,782,585 | B1 | 8/2004 | Conrad et al. |
| 6,829,804 | B2 | 12/2004 | Sepke |
| 6,902,596 | B2 | 6/2005 | Conrad et al. |
| 6,968,596 | B2 | 11/2005 | Oh et al. |
| 7,014,671 | B2 | 3/2006 | Oh |
| 7,097,680 | B2 | 8/2006 | Oh |
| 7,162,770 | B2 | 1/2007 | Davidshofer |
| 7,169,201 | B2 | 1/2007 | Oh et al. |
| 7,273,506 | B2 | 9/2007 | Oh et al. |
| 7,294,159 | B2 | 11/2007 | Oh et al. |
| 7,309,368 | B2 | 12/2007 | Oh et al. |
| 7,326,268 | B2 | 2/2008 | Oh et al. |
| 7,335,241 | B2 | 2/2008 | Oh et al. |
| 7,335,242 | B2 | 2/2008 | Oh |
| 7,361,200 | B2 | 4/2008 | Oh et al. |
| 7,429,284 | B2 | 9/2008 | Oh et al. |
| 7,731,770 | B2 | 6/2010 | Strutt et al. |
| 7,857,878 | B2 | 12/2010 | Park et al. |
| 2004/0194250 | A1 | 10/2004 | Conrad et al. |
| 2005/0177974 | A1 | 8/2005 | Conrad et al. |
| 2006/0137310 | A1 | 6/2006 | Conrad et al. |

DUAL STAGE CYCLONE VACUUM CLEANER

CROSS-REFERENCE TO RELATED APPLICATIONS

This application is a continuation of U.S. patent application Ser. No. 13/736,522, filed Jan. 8, 2013, which is a continuation of U.S. patent application Ser. No. 12/097,225, which is as a national-stage entry of PCT Application No. PCT/US2006/048800, filed Dec. 22, 2006, which claims priority to U.S. Provisional Patent Application No. 60/753,334, filed Dec. 22, 2005, the contents of all of which are hereby incorporated by reference.

BACKGROUND

The present invention relates to vacuum cleaners. More particularly, the present invention relates to dual stage cyclonic vacuum cleaners used for suctioning dirt and debris from carpets and floors. Such vacuum cleaners can be upright, canister hand-held or stationary, built into a house. Moreover, cyclonic designs have also been used on carpet extractors and "shop" type vacuum cleaners.

Upright vacuum cleaners are well known in the art. The two major types of traditional vacuum cleaners are a soft bag vacuum cleaner and a hard shell vacuum cleaner. In the hard shell vacuum cleaner, a vacuum source generates the suction required to pull dirt from the carpet or floor being vacuumed through a suction opening and into a filter bag or a dust cup housed within the hard shell upper portion of the vacuum cleaner. After multiple use of the vacuum cleaner the filter bag must be replaced or the dust cup emptied.

To avoid the need for vacuum filter bags, and the associate expense and inconvenience of replacing the filter bag, another type of upright vacuum cleaner utilized cyclonic air flow and one or more filters, rather than a replacement filter bag to separate the dirt and other particulates from the suction air stream. Such filters need infrequent replacement.

While some prior art cyclonic air flow vacuum cleaner designs and constructions are acceptable, the need exists for continued improvements and alternative designs for such vacuum cleaners. For example, it would be desirable to simplify assembly and improve filtering and dirt removal.

Accordingly, the present invention provides a new and improved upright vacuum cleaner having a dual stage cyclonic air flow design which overcomes certain difficulties with the prior art designs while providing better and more advantageous overall results.

BRIEF DESCRIPTION

In accordance with one aspect of the present invention, a home cleaning appliance includes a housing having a nozzle, which includes a main suction opening. An airstream suction source is mounted to the housing and includes a suction airstream inlet and a suction airstream outlet. The suction source selectively establishes and maintains a flow of air from the nozzle main suction opening to the airstream outlet. A cyclone main body is mounted to the housing and communicates with the nozzle main suction opening. The cyclone main body includes a first stage separator and a plurality of second stage separators. A dirt cup is connected to the cyclone main body for collecting dust particles separated by the first stage separator and the plurality of second stage separators. An air manifold is mounted to the first stage separator for fluidly connecting the first stage separator to the plurality of second stage separators. The air manifold includes a top wall and a side wall which cooperate to direct partially cleaned air from the first stage separator to the plurality of second stage separators. A mounting assembly is connected to the side wall and configured to secure the plurality of second stage separators to the air manifold. An outer cover is connected to the mounting assembly. The outer cover encircles the plurality of second stage separators. A cover is connected to the air manifold for directing air discharged from the plurality of second stage separators to the inlet of the airstream suction source.

In accordance with another aspect of the present invention, a home cleaning appliance includes a housing having a nozzle, which includes a main suction opening. An airstream suction source is mounted to the housing and includes a suction airstream inlet and a suction airstream outlet. The suction source selectively establishes and maintains a flow of air from the nozzle main suction opening to the airstream outlet. A cyclone main body is mounted to the housing and communicates with the nozzle main suction opening. The cyclone main body includes a first stage separator and a plurality of second stage separators. A dirt cup is connected to the cyclone main body for collecting dust particles separated by the first stage separator and the plurality of second stage separators. A plurality of isolated air conduits fluidly connects the first stage separator to the plurality of second stage separators. Each conduit includes a first section disposed longitudinally within the first stage separator and the dirt cup and a second section for directing a volume of partially cleaned air generally tangentially into an inlet of a respective second stage separator.

In accordance with yet another aspect of the present invention, a home cleaning appliance includes a housing having a nozzle, which includes a main suction opening. An airstream suction source is mounted to the housing and includes a suction airstream inlet and a suction airstream outlet. The suction source selectively establishes and maintains a flow of air from the nozzle main suction opening to the airstream outlet. A cyclone main body is mounted to the housing and communicates with the nozzle main suction opening. The cyclone main body includes a first stage separator and a plurality of second stage separators. A dirt cup is connected to the cyclone main body. The dirt cup includes first and second particle collectors. The first particle collector communicates with the first stage separator for collecting a first portion of dust particles. The separate second particle collector communicates with the plurality of second stage separators for collecting a second portion of dust particles. The second particle collector includes a plurality of separate fine dust compartments. Each fine dust compartment is fluidly connected to one of the plurality of second stage separators.

In accordance with still yet another aspect of the present invention, home cleaning appliance comprises a nozzle and a cyclone main body fluidly connected to the nozzle. The cyclone main body comprises a first stage cyclonic separator and a plurality of second stage separators. The first stage separator includes a cylindrical side wall, wherein cyclonic flow occurs adjacent said side wall. The plurality of second stage cyclonic separators are disposed adjacent the first stage separator and fluidly connected thereto. A longitudinally extending generally cylindrical central portion is located at least partially in the first stage separator. There is no airflow in the central portion.

Still other aspects of the invention will become apparent from a reading and understanding of the detailed description of the several embodiments described hereinbelow.

BRIEF DESCRIPTION OF THE DRAWINGS

The present invention may take physical form in certain parts and arrangements of parts, several embodiments of which will be described in detail in this specification and illustrated in the accompanying drawings which form a part of the disclosure.

DETAILED DESCRIPTION

It should, of course, be understood that the description and drawings herein are merely illustrative and that various modifications and changes can be made in the structures disclosed without departing form the spirit of the invention. Like numerals refer to like parts throughout the several views. It will also be appreciated that the various identified components of the vacuum cleaner disclosed herein are merely terms of art that may vary from one manufacturer to another and should not be deemed to limit the present invention. While the invention is discussed in connection with an upright vacuum cleaner, it could also be adapted for use with a variety of other household cleaning appliances, such as carpet extractors, bare floor cleaners, "shop" type cleaners, canister cleaners, hand-held cleaners and built-in units. Moreover, the design could also be adapted for use with robotic units which are becoming more widespread.

Figure 1:
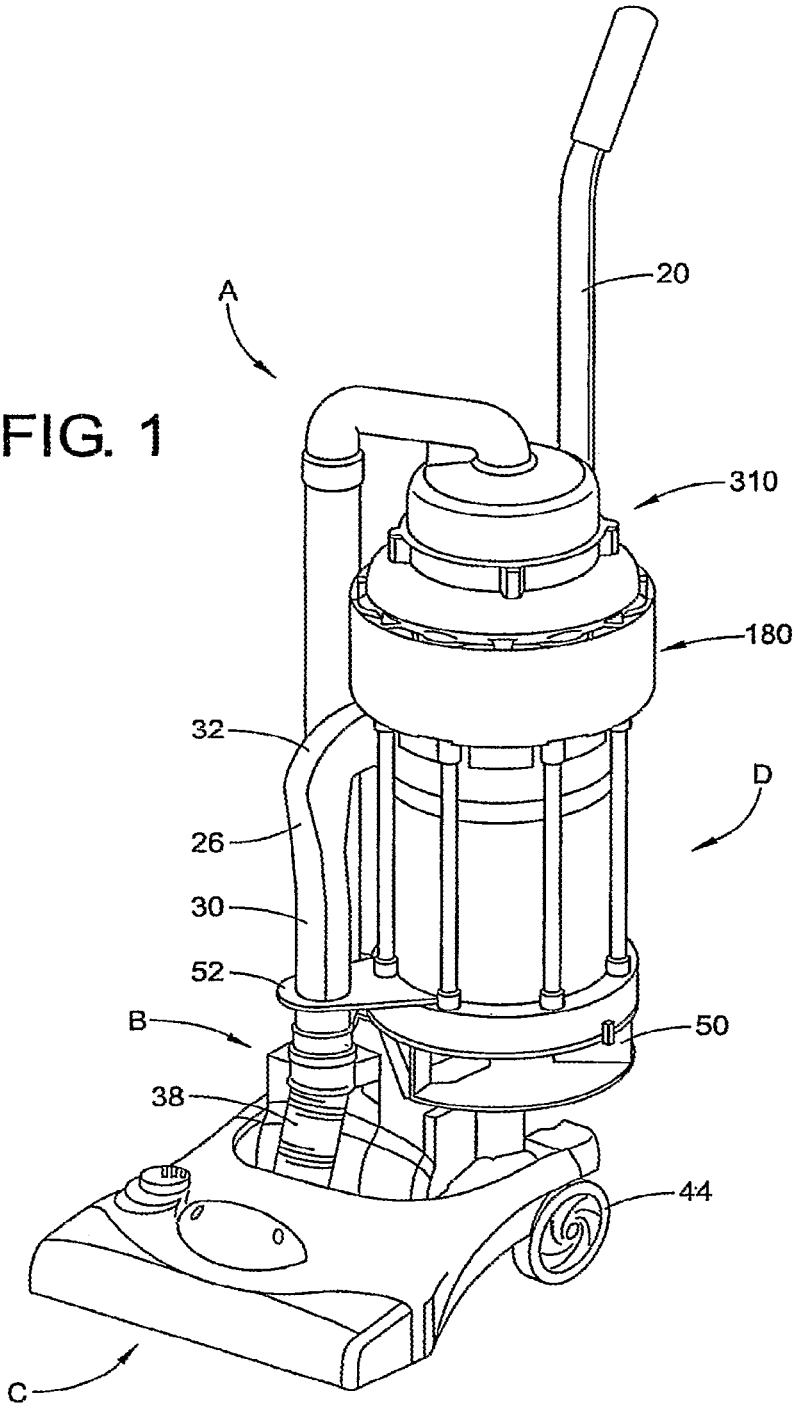
FIG. 1 is a front perspective view illustrating a dual stage cyclone vacuum cleaner in accordance with a first embodiment of the present invention.
Figure 2:
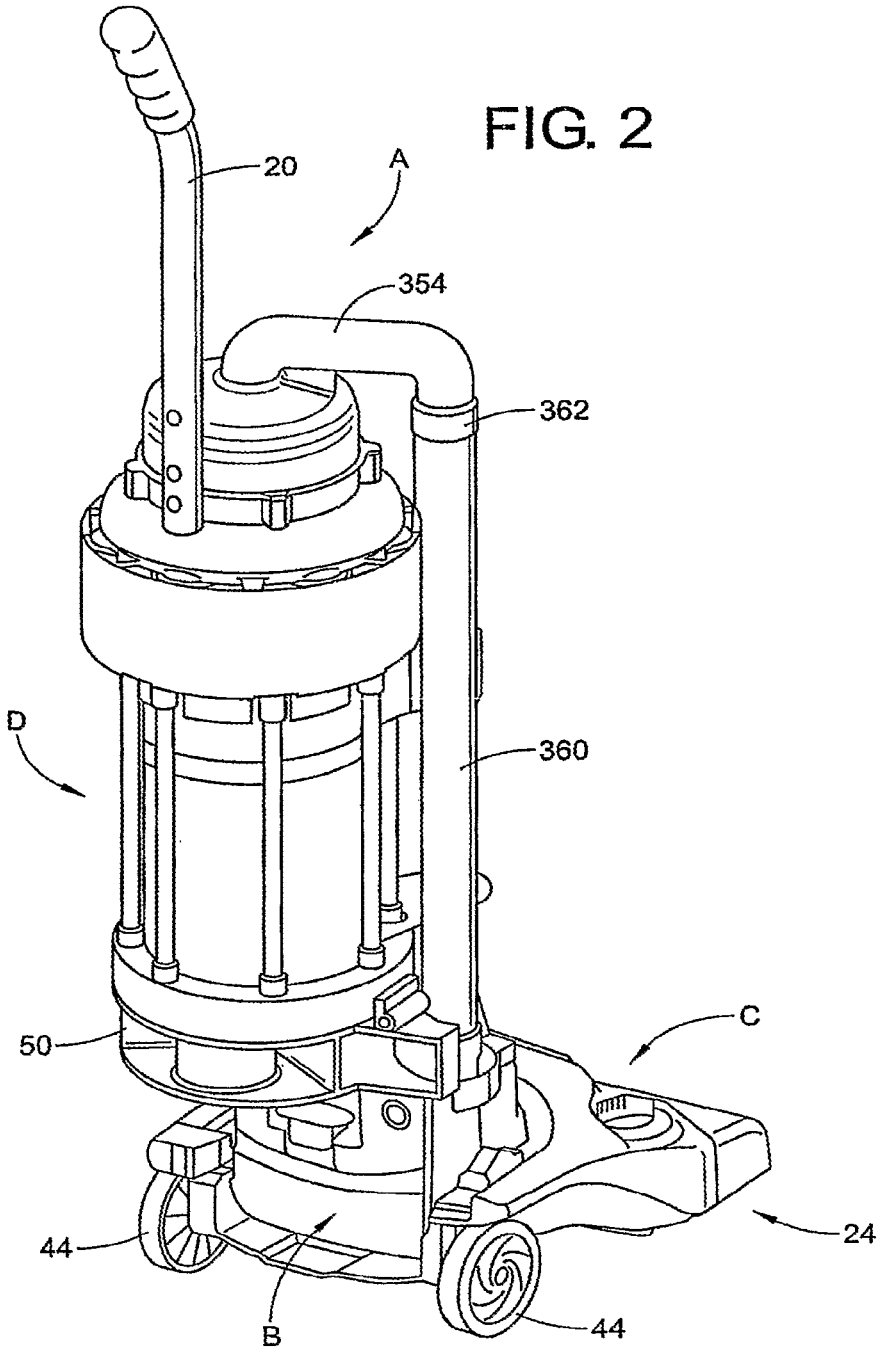
FIG. 2 is a rear perspective view of the dual stage cyclone vacuum cleaner of FIG. 1.

Referring now to the drawings, wherein the drawings illustrate the preferred embodiments of the present invention only and are not intended to limit same, FIGS. 1 and 2 illustrate an upright dual stage vacuum cleaner A including an electric motor and fan assembly B, a nozzle base C, and a dust collector D mounted stop the motor and fan assembly via conventional means. The motor and fan assembly B and the nozzle base C are pivotally or hingedly connected through the use of trunnions or another suitable hinge assembly, so that the motor and fan assembly including the dust collector D pivots between a generally vertical storage position (as shown) and an inclined use position. The nozzle base B can be made from conventional materials, such as molded plastics and the like. A handle 20 extends upward from the dust collector, by which an operator of the dual stage cyclone vacuum cleaner A is able to grasp and maneuver the vacuum cleaner.

During vacuuming operations, the nozzle base C travels across a floor, carpet, or other subjacent surface being cleaned. An underside of the nozzle base includes a main suction opening 24 formed therein, which can extend substantially across the width of the nozzle at the front end thereof. As is known, the main suction opening in fluid communication with the dust collector D through a conduit, which can be a center dirt passage 26. The center dirt passage includes a first section 30 having a longitudinal axis generally parallel to a longitudinal axis of the dust collector and a second section 32 having a longitudinal axis generally normal to the axis of the first section. The second section directs the air tangentially into the dust collector.

Figure 3:
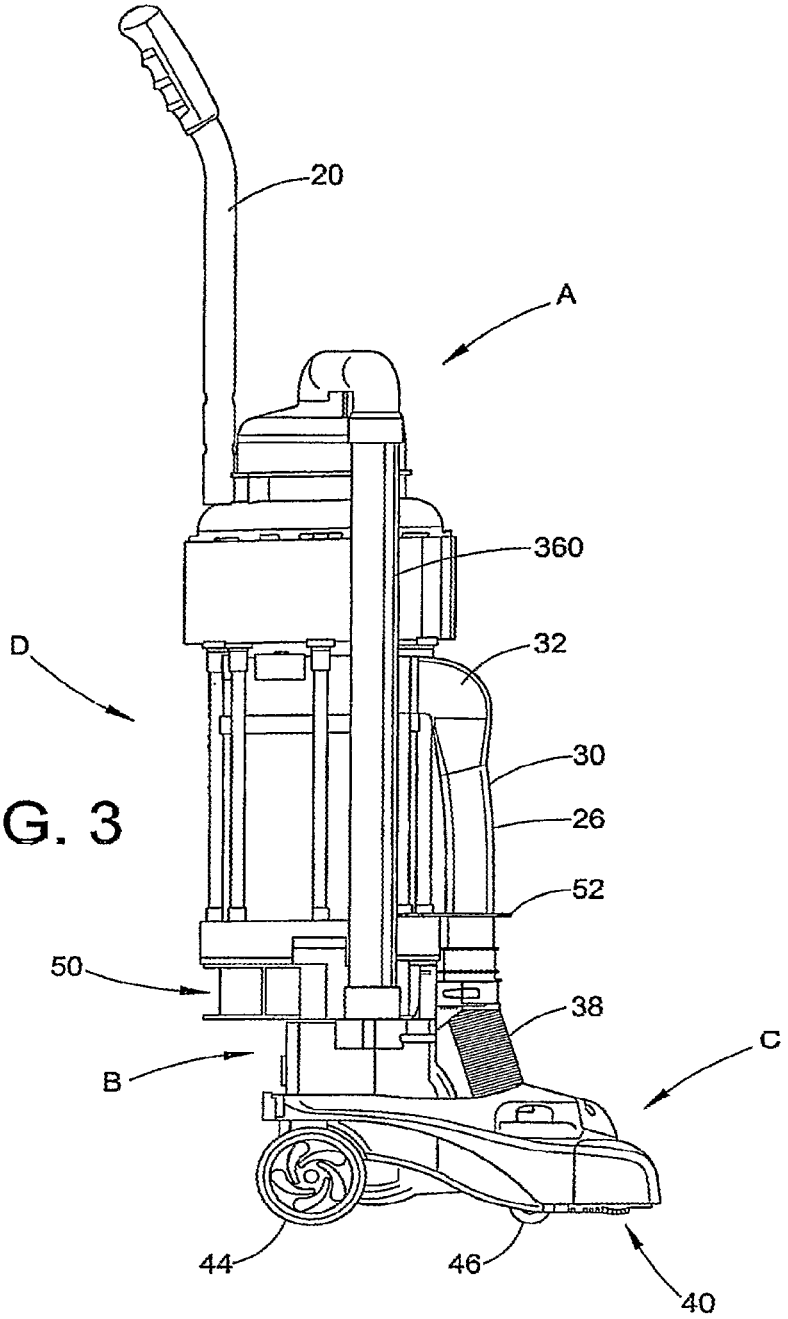
FIG. 3 is a left side elevational view of the dual stage cyclone vacuum cleaner of FIG. 1.
Figure 4:
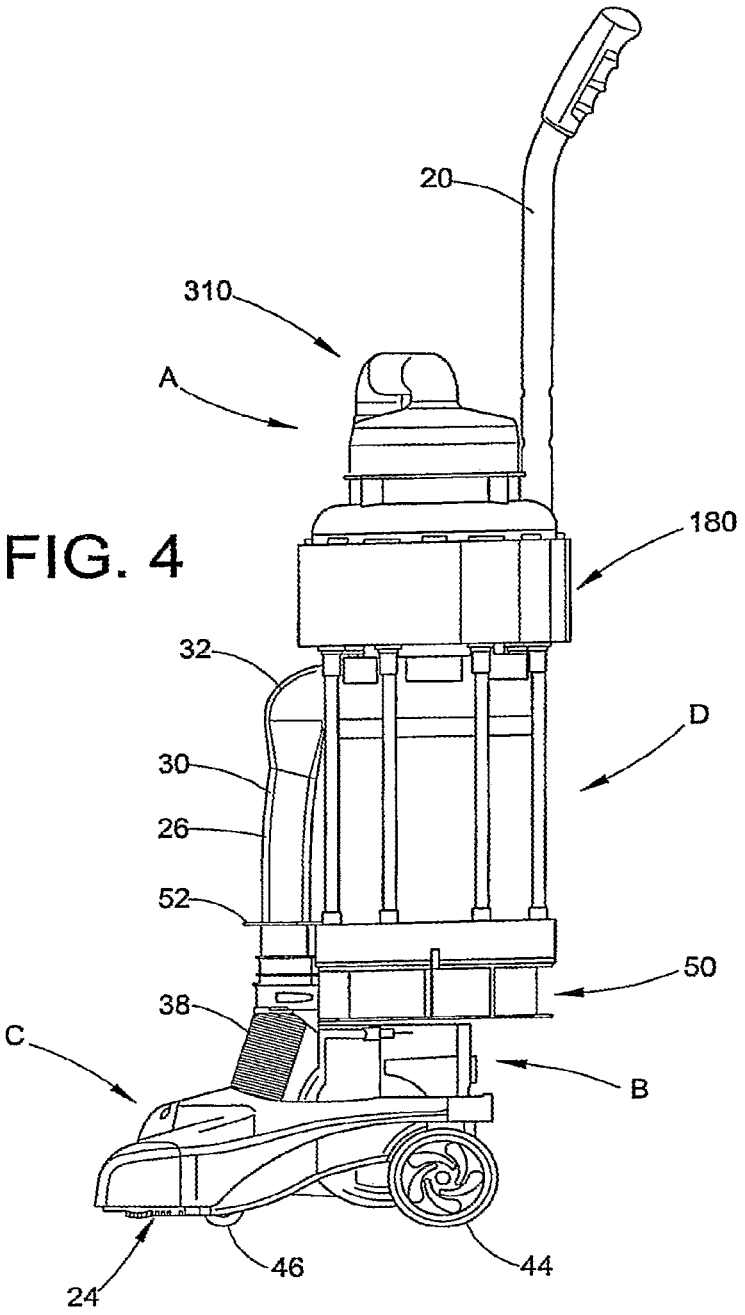
FIG. 4 is a right side elevational view of the dual stage cyclone vacuum cleaner of FIG. 1.

With additional reference to FIGS. 3 and 4, a connector hose assembly, such as at 38, fluidly connects the air stream from the main suction opening to the center dirt passage. A rotating brush assembly 40 is positioned in the region of the nozzle main suction opening 24 for contacting and scrubbing the surface being vacuumed to loosen embedded dirt and dust. A plurality of wheels 44, 46 supports the nozzle base on the surface being cleaned and facilitates its movement there across. A base member 50 is mounted to the electric motor and fan assembly B for releasably supporting the dust collector D. A latch assembly (not shown) can be mounted to the base member for securing the dust collector thereto. A support brace 52 extends from the base member and is attached to the center dirt passage to provide support.

Figure 5:
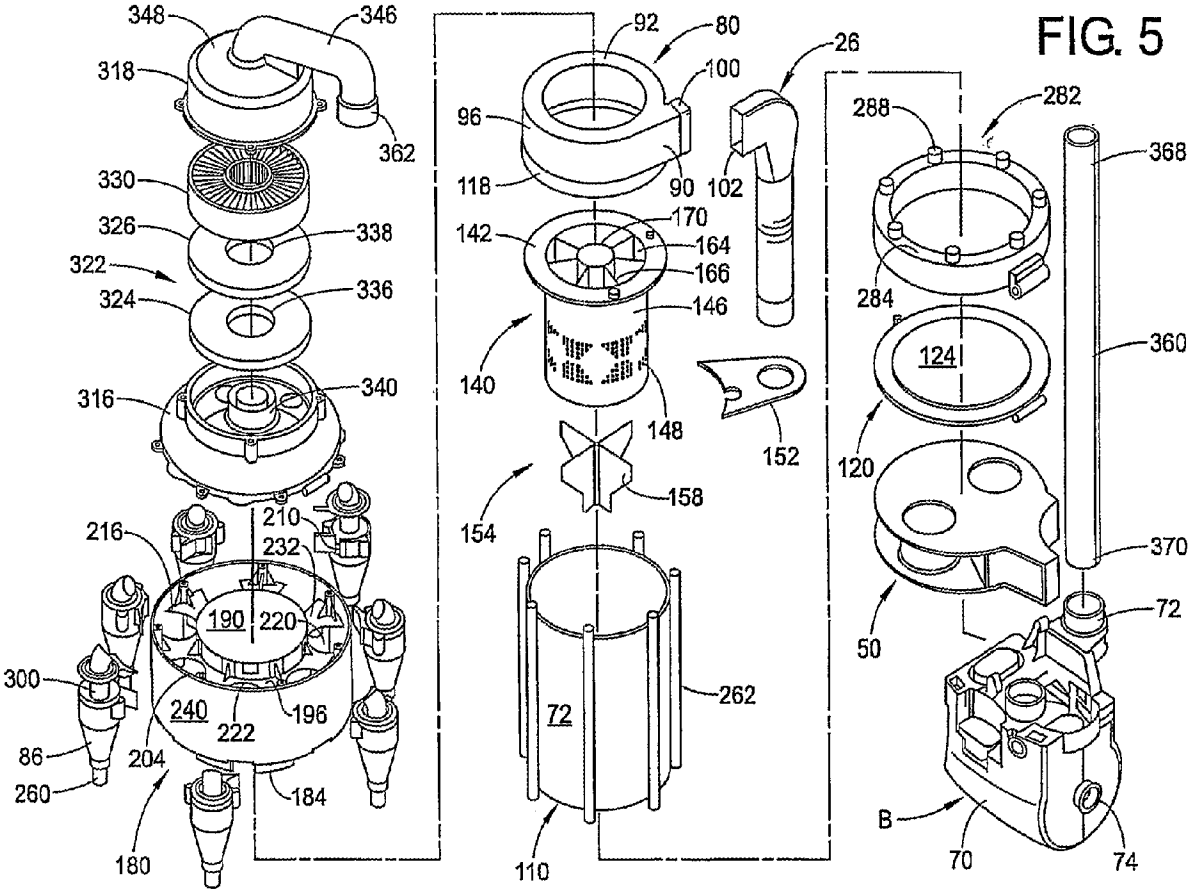
FIG. 5 is an enlarged exploded perspective view of a dust collector portion of a motor and fan assembly of the dual stage vacuum cleaner of FIG. 1, together with associated components thereof.

As shown in FIG. 5, the electric motor and fan assembly B is housed in a motor housing 70 which includes a hose connector 72 and an exhaust duct 74. The motor and fan assembly generates the required suction airflow for cleaning operations by creating a suction force in a suction inlet and an exhaust force in an exhaust outlet. The motor and fan assembly airflow exhaust outlet can be in fluid communication with an exhaust grill (not shown) covering the exhaust duct. If desired, a final filter assembly can be provided for filtering the exhaust air stream of any contaminants which may have been picked up in the motor assembly immediately prior to its discharge into the atmosphere. The motor assembly suction inlet, on the other hand, is in fluid communication with the dust collector D of the vacuum cleaner A to generate a suction force therein.

Figure 6:
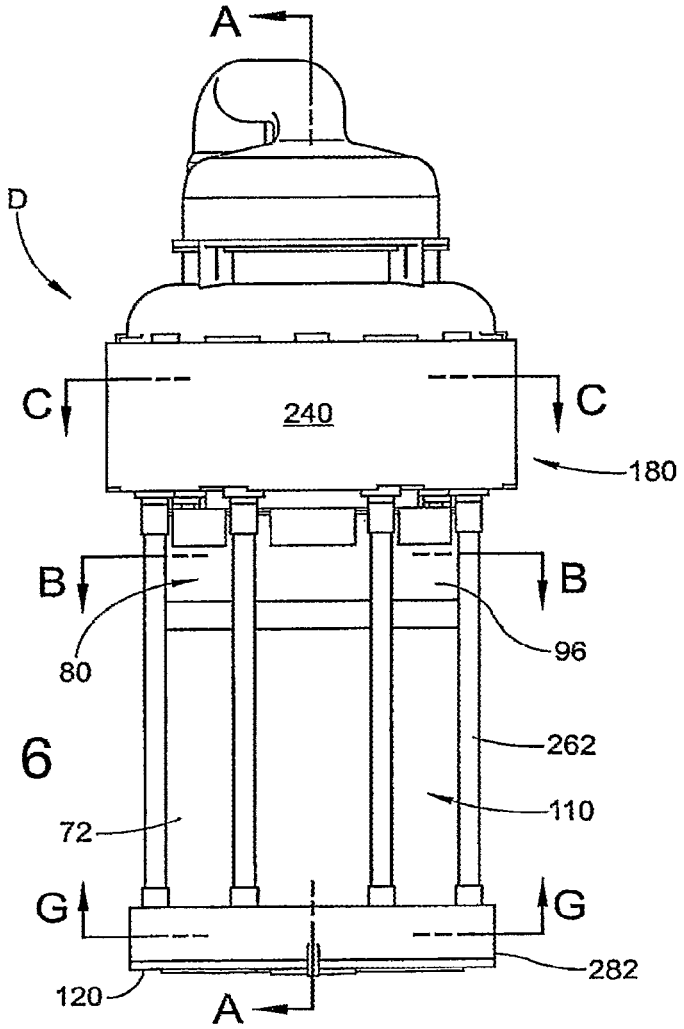
FIG. 6 is a front view of an assembled dust collector for the dual stage vacuum cleaner of FIG. 1.
Figure 7:
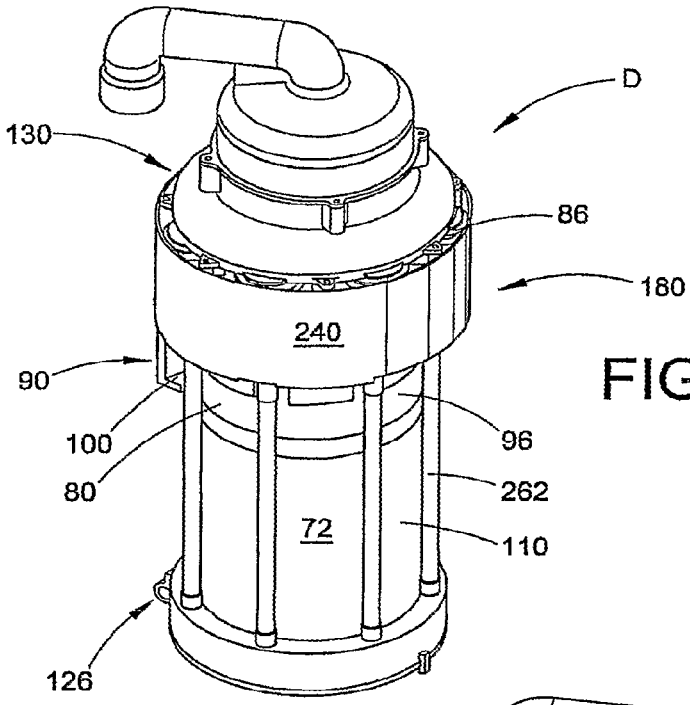
FIG. 7 is an enlarged front perspective view of an assembled dust collector for the dual stage vacuum cleaner of FIG. 1.

With continued reference to FIG. 5, and additional reference to FIGS. 6 and 7, the dust collector D includes a cylindrical-shaped first stage cyclone separator 80 and a plurality of spaced part, frusta-conical, downstream, second stage cyclonic separators 86.

The cylindrical first stage separator includes a dirty air inlet conduit 90, a top wall 92 and a sidewall 96 having an outer surface and an inner surface. In the depicted embodiment, the conduit 90 has an enlarged inlet 100 having an inner dimension greater than an outer dimension of an outlet end 102 of the second section 32 of the center dirt passage 26, such that the Outlet end is frictionally received in the enlarged inlet. However, it should be appreciated that the passage outlet end can have an inner dimension larger than an outer dimension of the conduit inlet, such that the conduit inlet is frictionally received in the passage outlet.

Figure 8:
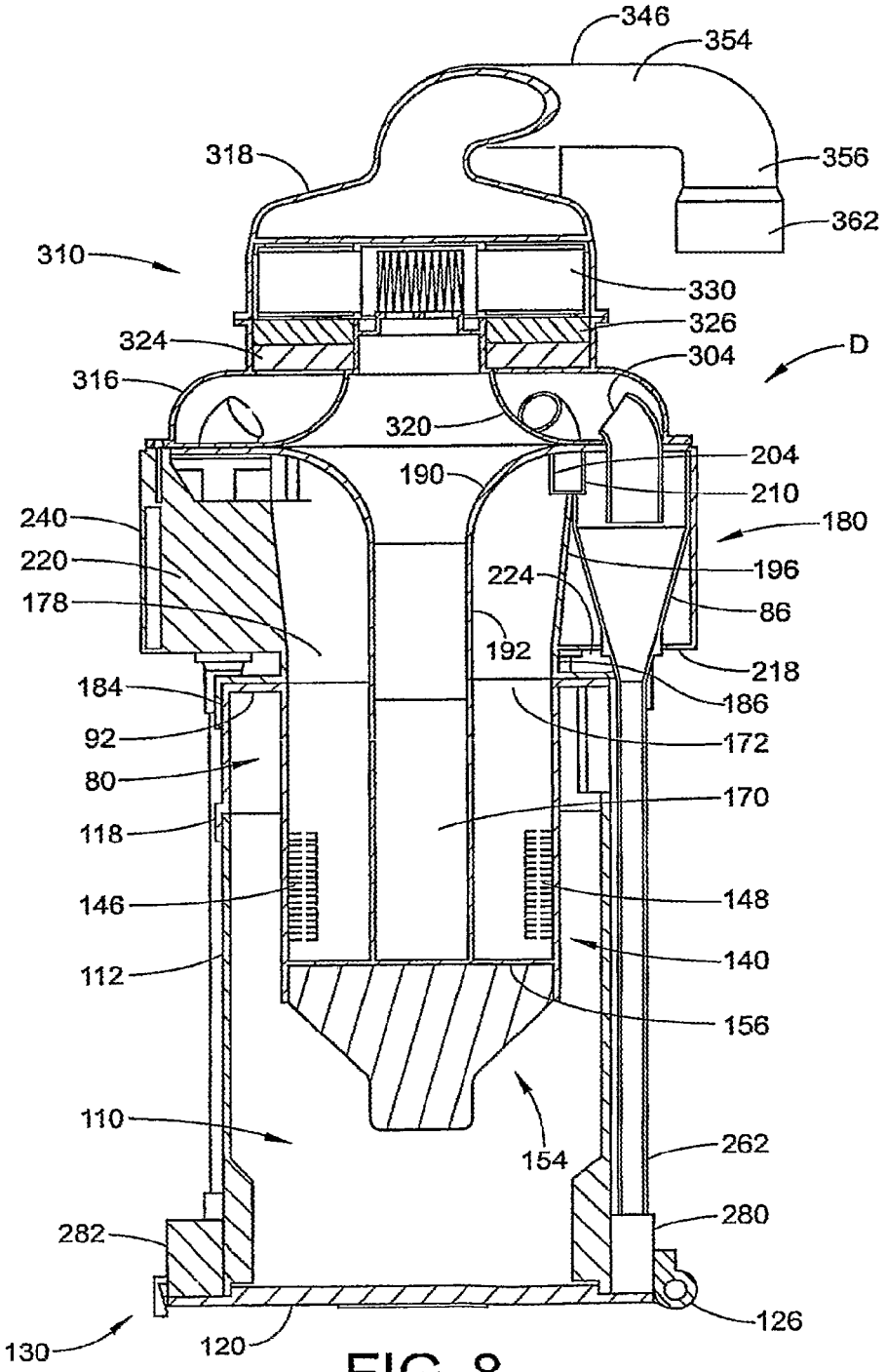
FIG. 8 is an enlarged cross-sectional view taken generally along section line A-A of the dust collect FIG. 6.

The airflow into the first stage separator 80 is tangential which causes a vortex-type, cyclonic or swirling flow. Such vortex flow is directed downwardly in the first stage separator by the top wall. Cyclonic action in the first stage separator 80 removes a substantial portion of the entrained dust and dirt from the suction air stream and causes the dust and dirt to be deposited in a dirt cup 110. As shown in FIG. 8, an open lower end of the first stage separator 80 is secured to an upper portion of a wall 112 of the dirt cup by a lip 118. The lip has a first section extending outwardly from the lower end and a downwardly extending second section. The lip is dimensioned to frictionally receive the wall of the dirt cup, thereby creating a seal between the first stage separator 80 and the dirt cup 110. These two elements can be secured together by adhesives, frictional welding or the like.

Figure 9:
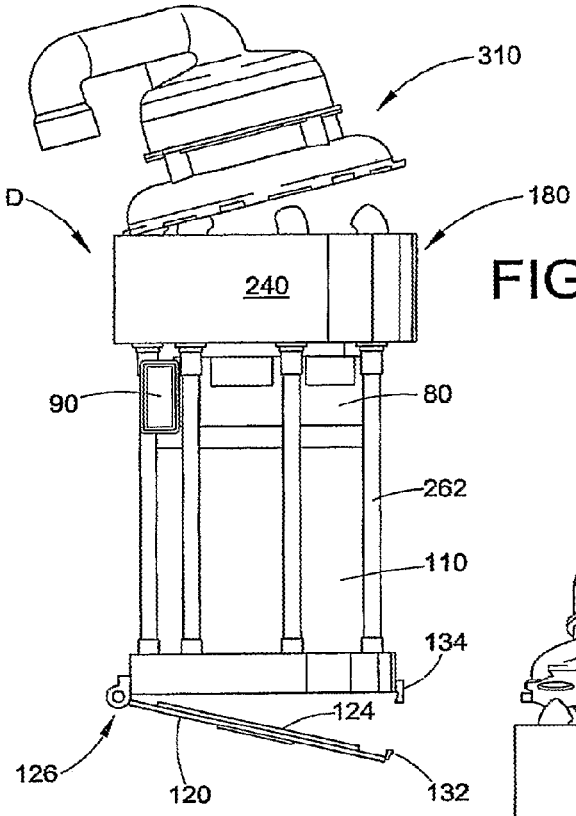
FIG. 9 is a side perspective view of the dust collector of FIG. 6 showing a bottom lid in an open position and a top cover partially opened.
Figure 10:
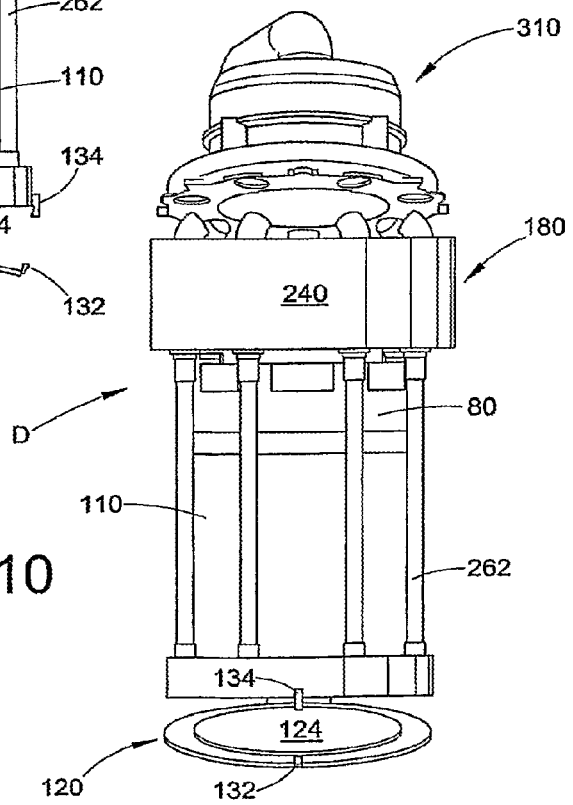
FIG. 10 is a front perspective view of the dust collector of FIG. 9.

Pivotally secured to a lower portion of the wall 112 of the dirt cup 110 is a bottom plate or lid 120, which allows for emptying of the dirt cup. As shown in FIG. 9, the lid can include a raised section or shelf 124. The raised section has an outer diameter slightly smaller than an inner diameter of the dirt cup 110 such that the raised section is received in the dirt cup. A seal ring (not shown) can be fitted over the raised section to create a seat between the lid and the first cup. As shown in FIGS. 9 and 10, a hinge assembly is used to mount the bottom lid to a bottom portion of the dirt cup. The hinge assembly allows the bottom lid to be selectively opened so that dirt and dust particles that were separated from the air stream by the first stage separator 80 can be emptied from the dust collector D. A latch assembly 130, which can be located diametrically opposed from the hinge assembly, can maintain the lid in a closed position. The latch assembly can include a finger 132 projecting from the lid and a catch 134.

Figure 11:
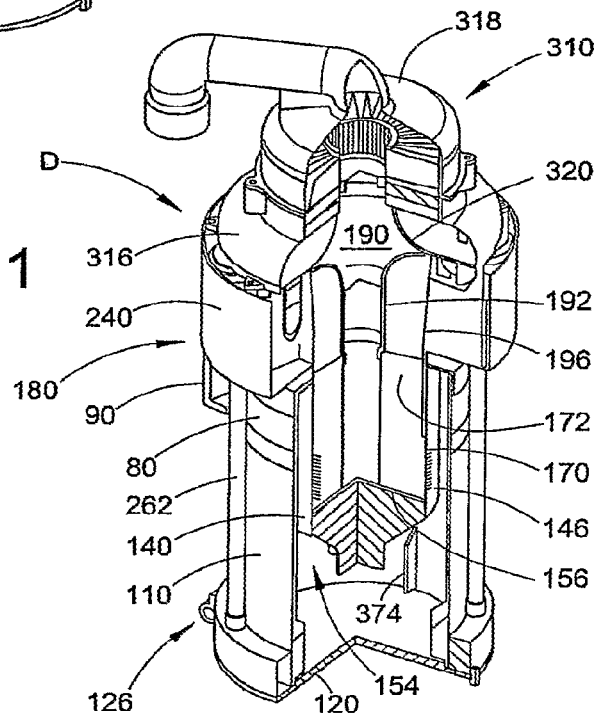
FIG. 11 is a perspective view, partially broken away, of the dust collector of FIG. 6.

With reference to FIGS. 8 and 11, fluidly connecting the first stage to the second stage is a perforated tube 140. The perforated tube is disposed within the first stage separator 80 and the dirt cup 110 and extends longitudinally from the top wall 92 of the separator. A flange 142 (FIG. 5) extends continuously around a top portion of the perforated tube. The flange sits on the top wall 92 and is dimensioned to effectively seal an upper portion of the first stage separator 80. The perforated tube can be made removable from the dust collector for cleaning purposes.

The perforated tube includes a cylindrical section 146 which is oriented generally parallel to the interior surface of the first stage separator sidewall 96 and the wall 112 of the dirt cup. In the present embodiment, the perforated tube has a longitudinal axis coincident with the longitudinal axes of the first stage separator and the dirt cup; although, it should be appreciated that the respective axes can be spaced from each other. A plurality of openings or perforations 148 is located around a portion of the circumference of the cylindrical section. The openings are useful for removing threads and fibers from the air stream which flows into the perforated tube. As might be expected, the diameter of the openings 148 and the number of those openings within the perforated tube 140 directly affect the filtration process occurring within the dirt cup. Also, additional openings result in a larger total opening area and thus the airflow rate through each opening is reduced. Thus, there is a smaller pressure drop and lighter dust and dirt particles will not be as likely to block the openings. The openings 148 serve as an outlet from the first cyclonic separation stage, allowing the partially cleaned fluid to enter the second stage separators 142.

Baffles or fins 154 can extend downwardly from a closed lower end 156 of the perforated tube 140. As shown in FIG. 5, the baffles can include a cross blade assembly 158, which can be formed of two flat blade pieces that are oriented approximately perpendicular to each other. It should be appreciated that the cross blade is not limited to the configuration shown in FIG. 5 but may be formed of various shapes such as a rectangular shape, a triangular shape or an elliptical shape, when viewed from its side. Also, in addition to a cross blade design, other designs are also contemplated. Such designs can include blades that are oriented at angles other than normal to each other or that use more than two sets of blades. These baffles can assist in allowing dirt and dust particles to fall out of the air stream between the perforated tube lower end 156 and the bottom lid 120 of the dirt cup 110.

Figure 12:
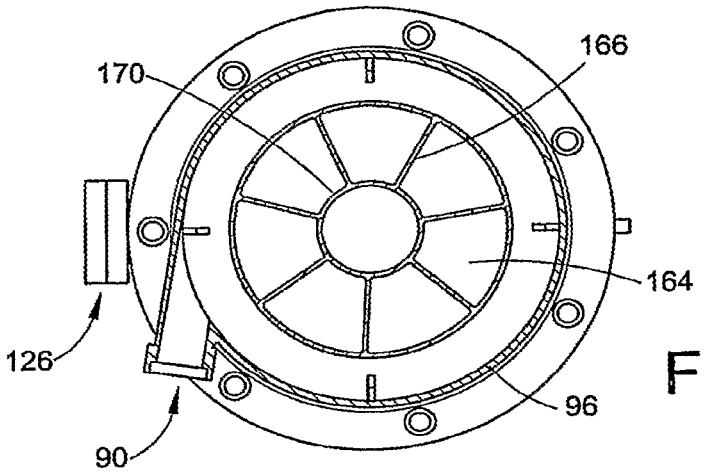
FIG. 12 is a cross-sectional view taken generally along section lines H-H of the dust collector of FIG. 6.

With reference to FIG. 12, the perforated tube can be separated into a plurality of isolated air conduits 164 by a plurality of dividing walls 166 which generally extend longitudinally through the perforated tube. The dividing walls eliminate cyclonic flow inside the perforated tube. The dividing walls have one end secured to an interior surface of the perforated tube and an opposed end secured to a tubular member 170 disposed within the perforated tube. While seven such walls are shown, a greater or smaller number can also be employed. The tubular member 170 defines a dead air space in the dust collector D and has a longitudinal axis coincident with the longitudinal axis of the perforated tube. As shown in FIG. 8, an upper end or air outlet 172 of the perforated tube 140 is in fluid communication with an air inlet section 178 of an air manifold 180 positioned above the first stage separator.

With the above described positioning of the perforated tube and the tubular member centrally within the dirt cup, a balanced airflow is achieved. Specifically, as depicted in FIG. 8, a volume (volume A) of air per unit height between an inner surface of the wall 112 of the dirt cup 110 and the perforated tube 140 is equal to a volume (volume B) of air per unit height between the perforated tube and the tubular member 170.

Figure 13:
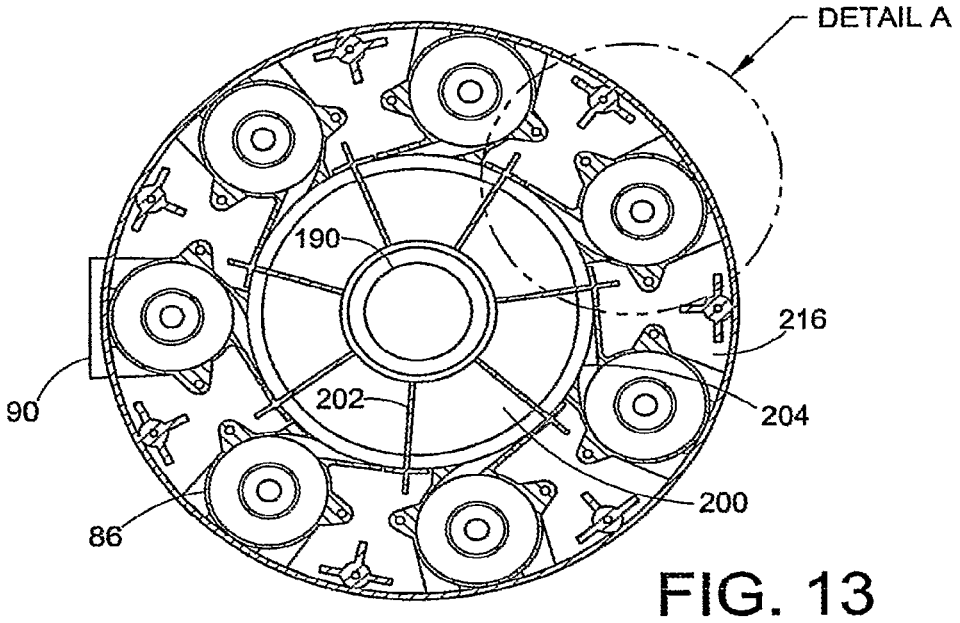
FIG. 13 is a cross-sectional view taken generally along section lines C-C of the dust collector of FIG. 6.
Figure 14:
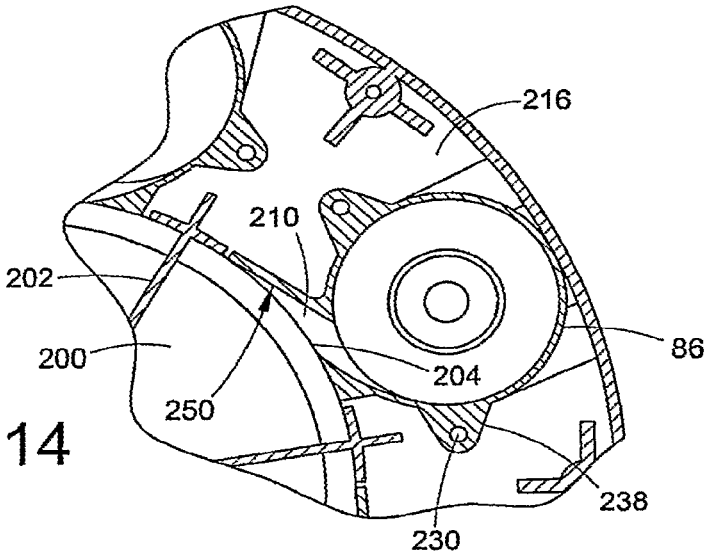
FIG. 14 is an enlarged view of detail A of the dust collector of FIG. 13.

With reference again to FIG. 5, the air manifold 180 is secured to the first stage separator 80 and the perforated tube 140 by spaced apart shoulders 184 extending from a lower end 186 of the manifold. The shoulders are fitted over the flange 142 of the perforated tube, the top wall 92 and a portion of the sidewall 96 of the first stage separator. As shown in FIG. 11 the air manifold includes a top wall 190 and tubular member 192 extending axially from the top wall. The tubular member has a longitudinal axis coincident with the longitudinal axis of tubular member 170. The top wall 190 and tubular member 192 together define a centrally located obconic, inversely conical, or funnel-shaped member. The funnel-shaped member, together with a sidewall 196 of the air manifold, directs partially cleaned air from the perforated tube 140 to the plurality of second stage separators 86. Similar to the perforated tube, and as shown in FIGS. 13 and 14, the air manifold is separated into a plurality of corresponding isolated air conduits 200 by a plurality of dividing walls 202. Each manifold air conduit 200 has an air outlet 204 located on the sidewall 196 which directs a volume of partially cleaned air to an inlet 210 of each second stage separator 86.

Figure 15:
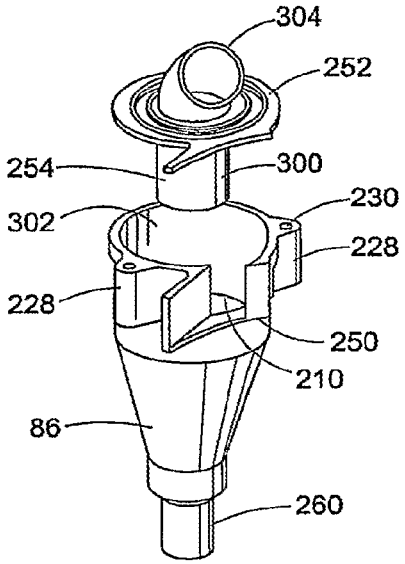
FIG. 15 is an enlarged perspective view of a downstream second stage cyclonic separator of the dust collector of FIG. 6.

The downstream separators 86 are arranged in parallel and are mounted radially on the air manifold above the top wall 92 of the first stage separator. In the depicted embodiment, extending radially from the sidewall 196 of the air manifold is an upper flange 216 (FIG. 5) and a lower flange 218 (FIG. 8). A strengthening member 220 extends between each flange to prevent deflection of the flanges. Each flange includes a cutout 224, 226, respectively, dimensioned to receive a portion of the downstream separator. With reference to FIGS. 5 and 15, extending outwardly from an upper portion of each downstream separator 86 are a pair of tabs 228, each tab including a hole 230. To mount the each downstream separator to the air manifold, the separator is positioned in the cutouts 224, 226. The holes 230 are then aligned with holes 232 located on the upper flange 216. A conventional fastener, such as a screw, can be threaded through the holes 230, 232 securing the downstream separator the upper flange 216. The air manifold 210 further includes an outer cover 240 which encases or surrounds the plurality of downstream separators 86.

Figure 16:
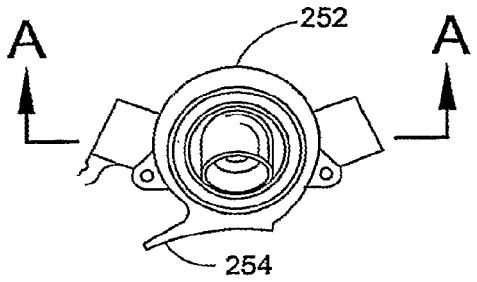
FIG. 16 is a top plan view of the downstream second stage cyclonic separator of FIG. 15.

As indicated above, each downstream separator 86 includes a dirty air inlet 210 in fluid communication with an air outlet 204 of the air manifold 180. The inlet has a first dimension and the air outlet has a second, larger, dimension. This arrangement allows the air stream to be drawn into each downstream separator by way of the venturi effect, which increases the velocity of the air stream and creates an increased vacuum in the inlet 210. With continued reference to FIGS. 15 and 16, extending outwardly from the inlet is an air path forming member 250 which directs the airflow into the separator tangentially. This causes a vortex-type, cyclonic or swirling flow. Such vortex flow is directed downwardly in the separator since a top end thereof is blocked by a flange 25. The flange has a projection 254 which covers an open end of the path forming member 250. Each second stage or downstream separator 86 can have a dimensional relationship such that a diameter of its upper end is three times the diameter of its lower end. This relationship is seen to improve the efficiency of cyclonic separation.

Figure 18:
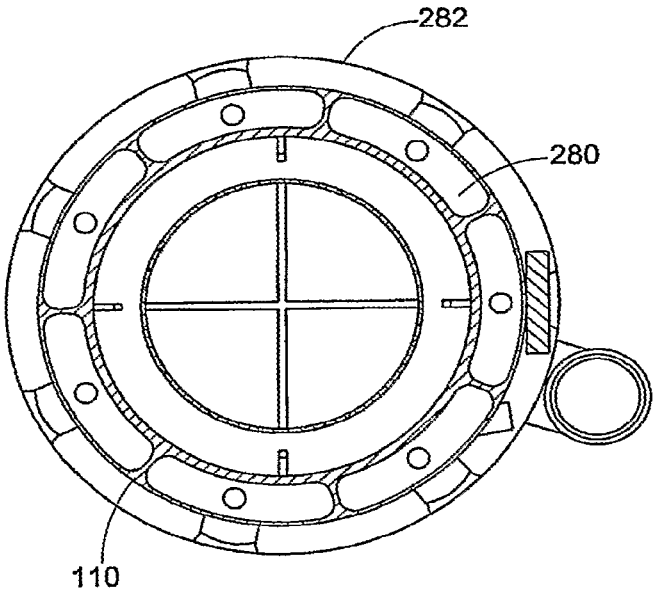
FIG. 18 is a cross-section view taken generally along section lines G-G of the dust collector of FIG. 6.
Figure 17:
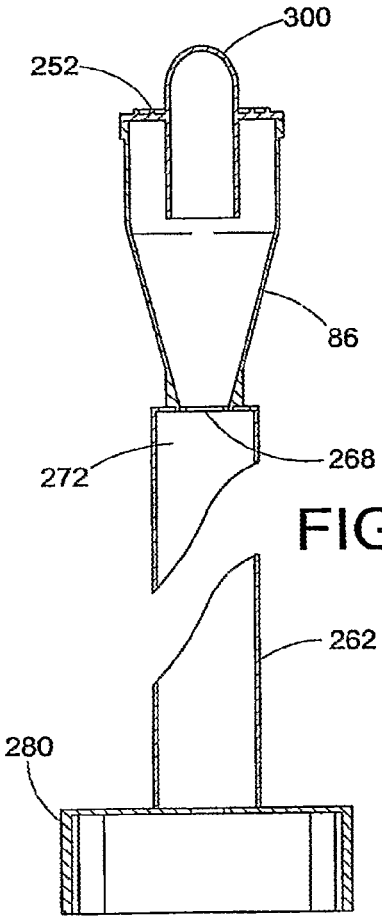
FIG. 17 is a cross-sectional view taken generally along section lines A-A of the downstream second stage cyclonic separator of FIG. 16.

With reference again to FIG. 8, and additional reference to FIG. 17, attached to a lower end 260 of each downstream separator 86 is a tube 262 for the passage of fine dirt separated by the downstream separator. The tube extends generally parallel to the outer surface of the wall 112 of the dirt cup 110. An inlet 268 of the tube has a rounded venturi throat (not shown) and expands into a larger cross-section area 272 to significantly reduce air velocities and prevent fine dust from being picked up by the air stream exiting the separator. Each tube can include a laminar flow member (not shown) to further stop the air from circulating within the tub. The separated dirt is collected in individual fine dust collectors 280 mounted at the other end of the tubes. The collectors are housed in a ring-shaped housing 282 (FIG. 5). Thus, and as shown in FIG. 18, the fine dust collectors are not fluidly connected to the dirt cup. As shown in FIG. 5, the tubes are attached to a top wall 284 of the housing by a plurality of hollow projections 288 dimensioned to receive an end of the tube. A bottom of each fine dust collector is closed by the bottom lid 120.

With reference to FIG. 15, a portion of an outlet channel 300 extends through an opening in the flange 252 and is inserted into an air outlet 302 of each downstream separator 86, so that purified air can be discharged from the cyclone through the outlet channel. The dimension of the outlet 302 can be three times the dimension of the inlet 210. As shown in FIG. 8, one end 304 of the outlet channel is cut at angle and sloped towards the center of a cyclone cover; 310 to direct air discharged from the downstream separators towards the center of the cover before being discharged tan inlet of the electric motor and fan assembly B.

The cyclone cover 310 includes a bottom plenum 316 and a conical shaped top plenum 318. As shown in FIGS. 9 and 10, the bottom plenum can be hinged to provide access to the second stage separators for cleaning. The bottom plenum collects a flow of cleaned air from the downstream separators 86 and includes a curved portion 320 which directs the cleaned air through a two stage filter assembly 322 (FIG. 5) for filtering any remaining fine dust remaining in the airflow exiting the downstream separators. The filter assembly includes a coarse foam layer 324 and a fine foam layer 326 housed in an upper portion of the bottom plenum. Located downstream therefrom is a pleated HEPA filter 330 housed in a lower portion of the upper plenum. By housing the HEPA filter in the cover 310, there is no need for an additional filter plenum. The coarse foam filter and the fine foam filter have center openings 336, 338, respectively, dimensioned to receive a post 340 extending upwardly from the curved portion. The filter assembly is can be easily serviced by swinging open the cyclone cover. The two foam filters can, if desired, be secured to each other by conventional means.

Figure 19:
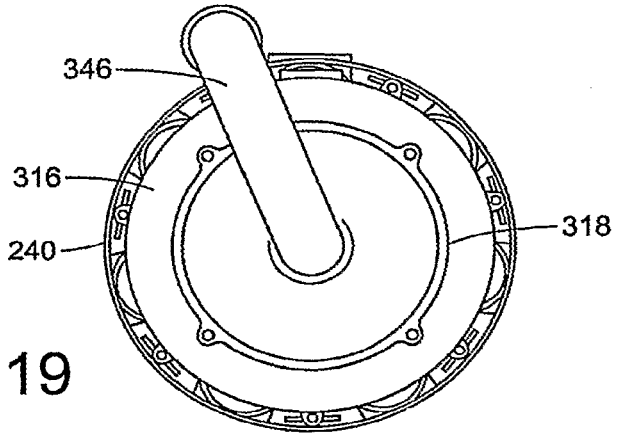
FIG. 19 is a top plan view of the dust collector of FIG. 6.

With reference again to FIG. 8, and additional reference to FIG. 19, the top plenum 318 collects a flow of cleaned air from the filter assembly and merges the flow of cleaned air into a first cleaned air outlet conduit 346 which is releasably connected to a top wall 348 of top plenum 318. The outlet conduit has a first section 354 projecting radially from the cover and a downwardly projecting second section 356. As shown in FIG. 2, a second cleaned air conduit 360 is attached to an end 362 of the first conduit. With reference again to FIG. 5, in this embodiment, the end 362 of the first conduit has an inner diameter greater than an outer diameter of a first end 368 of the second conduit such that the first end is frictionally received in the end 362. With continued reference to FIGS. 2 and 3, the second conduit has a longitudinal axis which is oriented approximately parallel to the longitudinal axis of the dust collector D. An outlet end 370 of the second conduit is attached to the hose connector 72 of the motor housing 70 and is in fluid communication with the inlet of the electric motor and fan assembly B.

In operation, dirt entrained air passes into the upstream cyclone separator 80 through the inlet 90 which is oriented tangentially with respect to the sidewall 96 of the separator. The air then travels around the separation chamber where many of the particles entrained in the air are caused, by centrifugal force, to travel along the interior surface of the sidewall of the separator and the dirt cup 110 and drop out of the rotating air flow by gravity. However, relatively light, fine dust is less subject to a centrifugal force. Accordingly, fine dust may be contained in the airflow circulating near the bottom portion of the dirt cup. Since the cross blade 158 extends into the bottom portion of the dirt cup, the circulating airflow hits the blade assembly and further rotation is stopped, thereby forming a laminar flow. In addition, if desired, extending inwardly from a bottom portion of the wall 112 of the dirt cup 110 can be laminar flow member's 374 (FIG. 11) which further prevents the rotation of air in the bottom of the dirt cup. As a result, the most of the fine dust entrained in the air is also allowed to drop out.

Figure 20:
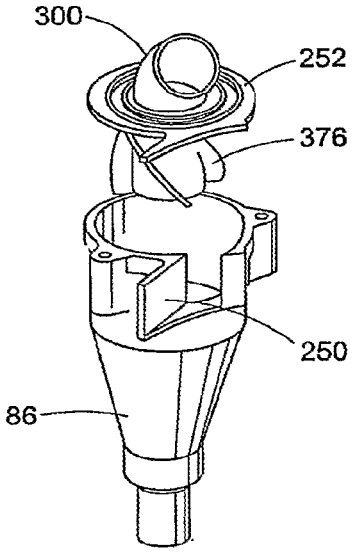
FIG. 20 is an enlarged perspective view of an alternative embodiment of a downstream second stage cyclonic separator of the dust collector of FIG. 6 according to the present invention; and, FIG. 21 is a cross-sectional view of a dust collector connected to a motor and fan assembly according to another embodiment of the present invention.

The partially cleaned air travels through the openings 148 of the perforated tube 140. In the tube, the flow will be laminar because the dividing walls 166, which extend between the inner wall of the tube and the tubular member 170, divide the tube into separate air conduits 164. The partially cleaned air travels through the air manifold 180 mounted above the perforated tube and into the frustaconical downstream cyclonic separators 86. There, the air cyclones or spirals down the inner surfaces of the cyclonic separators before moving upward into the cover 210. As shown in FIG. 20, the portion of the outlet channel 300 extending into each downstream separator can, in another embodiment, include helical blades 376 which further direct the air downwardly into the separator. Fine dirt separated in the downstream cyclonic separators falls down the tubes 262 and collects in the fine dust collectors 280. The cleaned air flows out of the downstream separators via the outlet channels 300 and into the bottom plenum 316, through the filter assembly 222, into the upper plenum 218 and to first and second conduits 346, 360, respectively. It will be appreciated that the volume of air in the bottom plenum before the foam filters can be generality the same as the volume of air in the upper plenum after the HEPA filter. The conduits are in fluid communication with the air inlet to the electric motor and fan assembly B.

Figure 21:
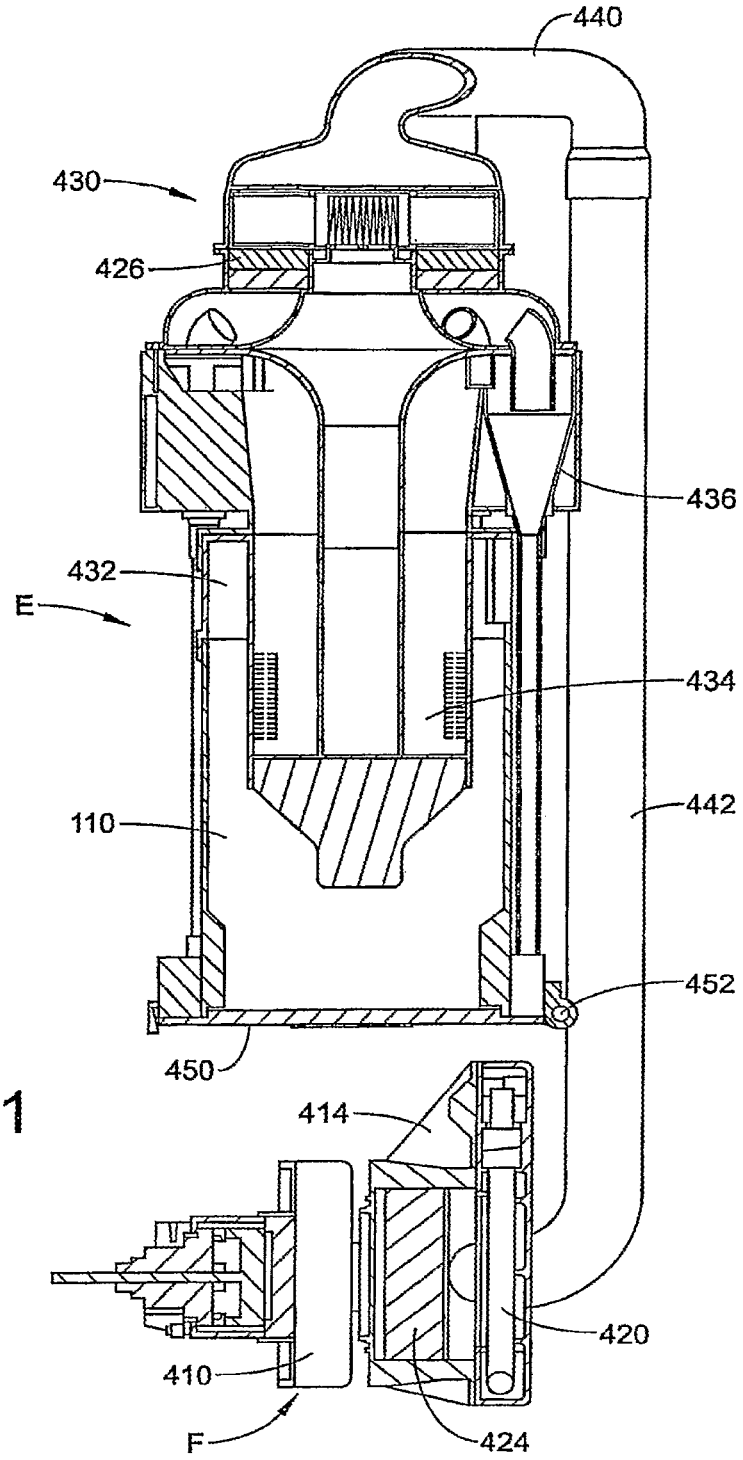

In another embodiment, and with reference now to FIG. 21, another dual stage cyclonic vacuum system comprises a dust collector E; connected to a suction source F. The suction source comprises a suction motor 410 held in a motor housing 414. Also mounted to the motor housing in this embodiment are an ultraviolet (UV) germicidal light source 420 and a HEPA filter 424. The UV light is not mounted in the cyclone cover because the foam filters are generally sensitive to UV-C radiation and tend to disintegrate. The HEPA filter filters any remaining contaminants prior to discharge of the air stream into the atmosphere. In the present embodiment, the UV light source generates a magnetic or electric field capable of emitting radiation powerful enough to destroy bacteria and viruses. The UV light source is preferably disposed adjacent the HEPA filter 424 so that the UV light source can shine on the filter. It has been proven that the residence time of bacteria, fungi and/or viruses trapped in or on the filter is great enough that exposure to the UV light source will either destroy the micro-organism or neutralize its ability to reproduce. The UV light source can be electrically connected to the same power source that powers the electric motor and fan assembly F.

In the embodiment of FIG. 21, the dust collector has a tangential inlet, a first stage separator 432, a perforated tube 434 and a plurality of second stage separators 436. Of course, any desired number of second stage separators can be employed. After the now twice cleaned air flows through the foam filter 426, it flows through conduits 440 and 442 and towards the suction source F. There it flows through the HEPA filter 424, the suction motor 410 and out of the vacuum cleaner.

To remove the dirt separated by the dual stage cyclone, a bottom lid 450 is pivoted open. A hinge assembly 452 allows the bottom lid to be selectively opened so that dirt and dust particles that were separated from the air stream can be emptied from the dust collector E.

The present disclosure has been described with reference to several preferred embodiments. Obviously, modifications and alterations will occur to others upon reading and understanding the preceding detailed description. It is intended that the disclosures be construed as including all such modifications and alterations insofar as they come within the scope of the claims appended hereto, as well as their equivalents.

What is claimed is:

1. A vacuum cleaner comprising:
- a nozzle including a suction opening;
- an airstream suction source operable to generate a flow of air through the suction opening; and
- a dust collector including,
  - a first stage cyclonic separator,
  - a plurality of second stage cyclonic separators in a parallel flow arrangement downstream from the first stage cyclonic separator,
  - a dirt cup configured to collect dust particles separated by the first stage cyclonic separator,
  - a perforated tube at least partially within the dust collector, the perforated tube having a cylindrical wall and a plurality of openings in the cylindrical wall to allow the flow of air to pass through the cylindrical wall in a flow direction from the first stage cyclonic separator toward the plurality of second stage cyclonic separators, and
  - a plurality of isolated air conduits within the perforated tube, each of the plurality of isolated air conduits defined at least partially by walls extending in a direction inwardly from the cylindrical wall of the perforated tube, wherein each of the plurality of second stage cyclonic separators has a corresponding one of the plurality of isolated air conduits.

2. The vacuum cleaner of claim 1, wherein the walls that at least partially define the plurality of isolated air conduits extend radially inward from the cylindrical wall of the perforated tube.

3. The vacuum cleaner of claim 1, wherein the number of plurality of isolated air conduits equals the number of plurality of second stage cyclonic separators.

4. The vacuum cleaner of claim 1, wherein each of the plurality of isolated air conduits is also defined at least partially by an inner wall extending in a circumferential direction within the perforated tube.

5. The vacuum cleaner of claim 1, wherein the cylindrical wall includes a section without openings that extends below the plurality of openings.

6. The vacuum cleaner of claim 1, further comprising a cross blade located at least partially within the perforated tube.

7. The vacuum cleaner of claim 1, further comprising a tube having a generally cylindrical section located within the perforated tube.

8. The vacuum cleaner of claim 1, wherein the first stage cyclonic separator is removably coupled to the dirt cup.

9. The vacuum cleaner of claim 1, wherein the dirt cup includes a first section configured to store dust particles separated from the first stage cyclonic separator and a second section configured to store dust particles separated from the plurality of second stage cyclonic separators.

10. The vacuum cleaner of claim 9, wherein the first section of the dirt cup and the second section of the dirt cup are arranged concentrically relative to one another.

11. The vacuum cleaner of claim 10, wherein the dust collector further includes a lid pivotally coupled to a bottom end of the dirt cup for removing dust collected within the dirt cup, wherein the lid simultaneously seals the first and second sections of the dirt cup.

12. The vacuum cleaner of claim 1, wherein the dust collector includes a lid pivotally coupled to the dirt cup to allow for emptying of the dirt cup.

13. The vacuum cleaner of claim 1, further comprising an air manifold positioned downstream of the perforated tube to direct the flow of air from the plurality of isolated air conduits to the plurality of second stage separators.

14. The vacuum cleaner of claim 1, wherein the plurality of isolated air conduits extend generally vertically.

15. The vacuum cleaner of claim 1, further comprising a nozzle base including the nozzle, wherein the dust collector is pivotally coupled to the nozzle base such that the dust collector pivots between a generally vertical storage position and an inclined use position.

16. The vacuum cleaner of claim 1, wherein the plurality of isolated air conduits is a first plurality of isolated air conduits, the dust collector further including a second plurality of isolated air conduits, wherein each of the second plurality of isolated air conduits is adjacent a corresponding inlet of each of the plurality of second stage cyclonic separators.

17. The vacuum cleaner of claim 1, further comprising an air filter downstream from the plurality of second stage cyclonic separators and a cyclone cover extending above outlets of the second stage separators, the cyclone cover configured to direct the flow of air from the plurality of second stage separators towards the air filter.

18. A vacuum cleaner comprising:

a nozzle base including a nozzle having a suction opening;

an airstream suction source operable to generate a flow of air through the suction opening; and a dust collector pivotally coupled to the nozzle base such that the dust collector pivots between a generally vertical storage position and an inclined use position, the dust collector including, a first stage cyclonic separator, a plurality of second stage cyclonic separators in a parallel flow arrangement downstream from the first stage cyclonic separator, a dirt cup configured to collect dust particles separated by the first stage cyclonic separator, the dirt cup including a first section configured to store dust particles separated from the first stage cyclonic separator and a second section configured to store dust particles separated from the plurality of second stage cyclonic separators, the first section of the dirt cup and the second section of the dirt cup are arranged concentrically relative to one another, a lid pivotally coupled to a bottom end of the dirt cup for removing dust collected within the dirt cup, an air filter downstream from the plurality of second stage cyclonic separators, a cyclone cover extending above outlets of the second stage separators, the cyclone cover configured to direct the flow of air from the plurality of second stage separators towards the air filter, a perforated tube at least partially within the dust collector, the perforated tube having a cylindrical wall and a plurality of openings in the cylindrical wall to allow the flow of air to pass through the cylindrical wall in a flow direction from the first stage cyclonic separator toward the plurality of second stage cyclonic separators, the cylindrical wall further including a section without openings that extends below the plurality of openings, and a plurality of isolated air conduits extending generally vertically within the perforated tube, each of the plurality of isolated air conduits defined at least partially by walls extending in a direction inwardly from the cylindrical wall of the perforated tube and an inner wall extending in a circumferential direction within the perforated tube, wherein each of the plurality of second stage cyclonic separators has a corresponding one of the plurality of isolated air conduits, wherein the number of plurality of isolated air conduits equals the number of plurality of second stage cyclonic separators.

19. The vacuum cleaner of claim 1, wherein the walls that at least partially define the plurality of isolated air conduits extend radially inward from the cylindrical wall of the perforated tube.

20. The vacuum cleaner of claim 1, wherein the first stage cyclonic separator is removably coupled to the dirt cup.

* * * * *